United States Patent [19]

Feldinger

[11] Patent Number: 5,012,788

[45] Date of Patent: May 7, 1991

[54] FUEL-AIR MIXTURE-FORMING DEVICE FOR INTERNAL COMBUSTION ENGINES

[75] Inventor: Martin Feldinger, Königstein, Fed. Rep. of Germany

[73] Assignee: VDO Adolf Schindling AG, Frankfurt am Main, Fed. Rep. of Germany

[21] Appl. No.: 494,637

[22] Filed: Mar. 15, 1990

[30] Foreign Application Priority Data

May 31, 1989 [DE] Fed. Rep. of Germany ..... 3917681

[51] Int. Cl.[5] ..... F02M 19/08; F02M 9/12

[52] U.S. Cl. ..... 123/545; 123/547; 123/590; 261/DIG. 56; 261/144

[58] Field of Search ..... 123/545, 547, 543, 557, 123/590; 48/180.1, 189; 261/DIG. 56, DIG. 78, 44.5, 145, 144

[56] References Cited

U.S. PATENT DOCUMENTS

| | | | |
|---|---|---|---|
| 1,973,362 | 9/1934 | Weiertz et al. | 261/DIG. 78 |
| 2,034,048 | 3/1976 | Leibing et al. | 261/DIG. 78 |
| 2,084,340 | 6/1937 | Hartsough | 261/DIG. 56 |
| 2,572,338 | 10/1951 | Hartwig et al. | 48/180.1 |
| 2,646,264 | 7/1953 | Morris | 261/44.5 |
| 4,008,699 | 2/1977 | Braun et al. . | |

FOREIGN PATENT DOCUMENTS

| | | | |
|---|---|---|---|
| 0084639 | 8/1983 | European Pat. Off. . | |
| 2058992 | 6/1972 | Fed. Rep. of Germany | 261/DIG. 56 |
| 3643882 | 6/1988 | Fed. Rep. of Germany . | |

*Primary Examiner*—Andrew M. Dolinar
*Assistant Examiner*—M. Macy
*Attorney, Agent, or Firm*—Martin A. Farber

[57] ABSTRACT

The present invention proposes a fuel-air mixture-forming device for internal combustion engines, having a rotationally symmetric nozzle body (2) which, together with a rotationally symmetric throttle body (8) displaceable in it, forms a convergent-divergent nozzle which discharges into a radial diffusor (6). In the vicinity of the narrowest cross section (5) of the nozzle there is provided a fuel slot (11) extending around it and discharging into it, at least one fuel feed line (9, 10) discharging into the fuel slot. The radial diffusor is formed by a region of the nozzle body which is curved outward in the direction of flow of the mixture and by a wall (15) of a structural member (17) which forms a structural unit (18) with an intake manifold (7) of the internal combustion engine, the wall (15) lying opposite the nozzle body and being rotationally symmetric to the longitudinal axis (1) of the throttle member and having a bulge (16) pointing toward the throttle member. Due to its development, the radial diffusor makes it possible that a film of fuel which necessarily adheres to the diffusor wall upon injection of the fuel detaches itself, whereby an improved mixture is formed.

6 Claims, 1 Drawing Sheet

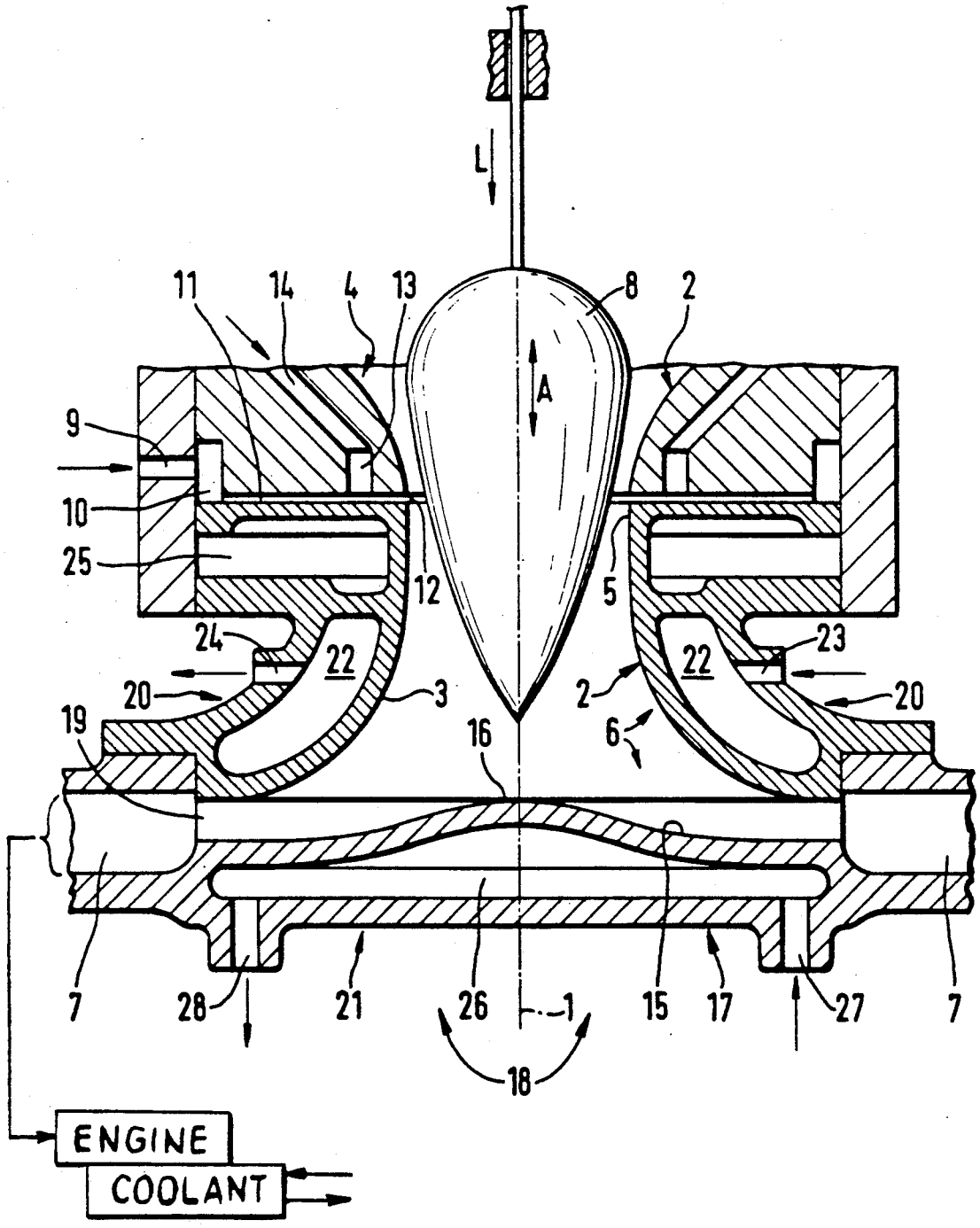
L
11
14
4
13
8
2
A
9
10
25
12
5
24
22
23
22
20
3
2
20
19
16
6
7
28
21
26
1
15
17
27
7
18
ENGINE
COOLANT

FUEL-AIR MIXTURE-FORMING DEVICE FOR INTERNAL COMBUSTION ENGINES

FIELD AND BACKGROUND OF THE INVENTION

The present invention relates to a fuel-air mixture-forming device for internal combustion engines, the device having a nozzle body of rotational symmetry which, together with a throttle member or rotational symmetry which is displaceable in it, forms a convergent-divergent nozzle which discharges into a radial diffusor, there being a slot which extends around the nozzle in the vicinity of its narrowest cross section, and discharges into the diffusor. At least one fuel line opens into the slot.

The more homogeneous the fuel-air mixture has been made by the mixture-forming device before entering the combustion chambers of the engine and the smaller the droplets of fuel present in this mixture, the smaller the actual fuel consumption will be and the more uniform the combustion, not only upon successive work cycles in one and the same cylinder but also in all cylinders of the engine, and the higher the obtainable engine output will be.

In a mixture-forming device of the type indicated known from West German 36 43 882 A1, the fuel is fed in the form of a film over the entire circumference of the nozzle in a direction transverse to the direction of flow of the air flowing through the nozzle. The main mass of the fuel fed is subsequently atomized by the mass of air flowing transverse to the film of fuel, the size of the resultant droplets decreasing with increasing speed of the stream of air. As a result of adhesion, the fuel flowing in the radial slot adheres to its walls and even after passage into the divergent nozzle region of the nozzle body, the fuel continues to adhere to the walls thereof in a more or less thick film.

The nozzle discharges into a strongly outwardly curved radial diffusor, with the result that the film of fuel detaches itself in the form of larger droplets in the region of the curvature due to the merely low speed of the air and the centrifugal action there, in contrast to the much smaller droplets in the center of the flow of the fuel-air mixture. The result is a thicker film of fuel in the intake pipe with the resultant disadvantage of a non-uniform composition of the mixture composition for the individual cylinders and for one and the same cylinder upon successive operating cycles, which leads to a non-steady loading of the engine and causes changes in the average composition of the exhaust, so that an impairment of the exhaust gas quality can be noted even behind the catalyst.

SUMMARY OF THE INVENTION

It is an object of the present invention further to develop a device of the type indicated in such a manner that an improved formation of the mixture is assured.

According to the invention, the radial diffusor (6) is formed by a region of the nozzle body which is curved outward in the direction of flow of the mixture and by a wall (15) of a structural part (17), the wall (15) lying opposite a throttle member (8) and being of rotational symmetry with respect to a longitudinal axis (1) of the throttle member (8), the structural part (17) forming a structural unit (18) with an intake pipe (1) of the internal combustion engine and the wall (15) having a bulge (16) facing the throttle member (8).

It is a basic feature of the present invention that, as far as possible, the nozzle body is curved outward with minimum radii of curvature as from the narrowest cross section of the nozzle and that the bulge which faces the throttle member is curved with minimal radii of curvature and to such an extent in the direction of the throttle member that the diffusor function is assured by cooperation of the corresponding region of the nozzle body with the arched wall which is directed toward the throttle member. The minimal radii of curvature of said region of the nozzle body and of the wall provide assurance that no detachment of the stream takes place on the structural parts flowed around and that, thus, the film of fuel is also not detached in the form of large droplets. The fuel-air mixture-forming device with radial diffusor in accordance with the invention thus combines the structural advantages with respect to the smaller structural length when using a radial diffusor with the hydraulic advantage but structural disadvantages of a straight diffusor.

In accordance with a special embodiment of the invention, it is proposed that the outwardly curved region of the nozzle body (2) be provided with a heating device (20). The heating should, in this connection, start as close as possible behind the place of the feeding of the fuel and thus the slot debouching into the nozzle It can be effected, for instance, electrically and/or—preferably—by a fluid heated by the internal combustion engine, in particular cooling water, lubricating oil or exhaust gas. By effecting the heating in the curved region of the nozzle body, in which case the heating device should advisedly be arranged in the direct vicinity of the inner wall of the corresponding section of the nozzle body within the latter, the film of fuel present on the inner wall evaporates almost completely, and this all the more so the more strongly the nozzle body is heated. The possibility of heating thus further improves the hydraulic advantages obtained by the special development of the radial diffusor. It is furthermore considered advisable to provide the structural member (17), which has the wall (15) of rotational symmetry, also with a heating device (21). The heating of this structural member can also be effected, for instance, electrically and/or by a fluid heated by the internal combustion engine.

BRIEF DESCRIPTION OF THE DRAWING

With the above and other objects and advantages in view, the present invention will become more clearly understood in connection with the detailed description of the preferred embodiment, when considered with the accompanying drawing in which the sole FIGURE shows a longitudinal section through an embodiment of the fuel-air-mixture-forming device in accordance with the invention, without being limited thereto.

DETAILED DESCRIPTION OF THE PREFERRED EMBODIMENT

The reference number 1 designates a longitudinal axis of the fuel-air-mixture-forming device around which parts of this mixture-forming device are developed symmetrically. A nozzle body 2 with its inner wall 3 is shaped substantially with rotational symmetry. This space within the nozzle body which is defined by the inner wall tapers continuously downward in its upper region 4 to a point of the narrowest inside cross section at the reference number 5. This point is adjoined in downward direction by a radial diffusor 6. At the top, the fuel-air mixture-forming device is acted on by air through an air filter, not shown. The main stream of air, therefore, flows in the direction of the arrow L from the top downward and then, at the right angle thereto, radially outward.

A throttle member 8, which is also formed with rotational symmetry around the longitudinal axis, serves, in combination with the nozzle body, to regulate the main stream of air, the throttle member being adjustable for this purpose in the direction of the longitudinal axis in accordance with the double arrow A. An upper part of the throttle member widens continuously from the top and passes into an essential lower part of the throttle member which tapers continuously downward.

The passage for the stream of air between the nozzle body and the throttle member is therefore more constricted the further the throttle member is displaced downward. Together with the throttle member the nozzle body forms a convergent-divergent nozzle.

For feeding fuel into the inner space of the nozzle body, the wall of the nozzle body is provided with a fuel feed bore 9 which, via a fuel annular channel 10, passes into a fuel slot 11. The fuel slot lies in a cross-sectional plane in the vicinity of the narrowest inside cross section and has a slot opening 12 which is directed towards the inside of the nozzle body. The slot opening therefore extends over 360° in the same way as the circumferential fuel slot. For uniform distribution of the stream of fuel which enters the nozzle body over its circumference, the fuel annular channel is developed with a relatively small resistance to flow, while the fuel slot has a relatively high resistance to flow.

In addition to fuel, air is introduced into the fuel slot under higher pressure, approximately under ambient air pressure. For this purpose, the fuel slot is connected via an air annular channel 13 and bores 14 to a section of the inner space (not shown in detail) in the nozzle body in which substantially ambient air pressure prevails, while in the slot opening 12 an air pressure amounting to about half the ambient pressure prevails and the air flows at this place with the speed of sound. By the feeding of the air, the formation of vapor bubbles is avoided since the fuel is practically under atmospheric pressure here.

The air feed and the fuel slot adjoining it are so dimensioned that some air is mixed with the fuel within them. The fuel emerging from the slot opening 12 is thereby imparted a higher velocity than without such admixing of air. As a result, the feeding of fuel to the combustion air or to the stream of air thus takes place uniformly over the circumference of the nozzle body and in the form of a film. Nevertheless, it can be noted during the operation of the fuel-air mixture-forming device described, that the fuel flowing in the fuel slot 11 adheres to its walls as a result of adhesion and continues to adhere to the inner wall of the diffusor in a more or less thick film, even after passing into the diffusor.

In order to provide assurance that the film of fuel does not detach from the wall 3 of the radial diffusor, the radial diffusor is developed in a special manner. Thus the radial diffusor is formed by a region of the nozzle body which is curved outward in the direction of flow of the mixture and by a wall 15 which lies opposite the throttle member and is of rotational symmetry with respect to the axis of rotation of the throttle member, the wall 15 having a bulge 16 directed toward the throttle member. The wall 15 is part of a structural part 17 which forms a structural unit 18 together with an intake pipe 7 of the internal combustion engine. It can be specifically noted from the FIGURE that, together with the throttle member, the nozzle body forms downstream of the slot opening 12 the divergent region of the nozzle which discharges into the radial diffusor the cross-sectional passage of which is continuously tapered up to its radial discharge opening 19, which represents the transition to the intake pipe 7. The required bulge of the wall 15 in the direction toward the throttle member is, in this case, dependent on the flow conditions.

The manner of operation of the radial diffusor of the invention which is intended to prevent a detachment of the air from the wall 3, is assisted by the fact that, in the device shown, both the outwardly curved region of the nozzle body and the structural part having the wall 15 are provided with a heating device 20 and 21, respectively. The heating device 20 has a heating channel 22 which is arranged in the nozzle body in the region of its inner wall, the heating channel being developed in ring-shape and thus completely surrounding the inner wall of the diffusor. The heating channel is provided with an engine cooling-water inlet 23 and, opposite it, an engine cooling-water outlet 24, the heating of the diffusor thus being effected by the hot engine cooling water.

In order that the fuel, which is fed radially to the diffusor, is not heated by the engine cooling-water—which could subsequently lead to the formation of vapor bubbles—the heat resistance between the engine cooling water and the fuel-conducting channels is kept as great as possible by the structural development of the fuel-air mixture-forming device. Thus, in the region of the fuel slot and the slot opening, the nozzle body has a small wall thickness and an air-filled hollow space 25, which counteract undesired heating of the fuel, thus assuring a high heating efficiency of the nozzle body in the region of the diffusor. The heating results in almost complete evaporation of the film of the fuel present on the wall of the diffusor. In order further to reduce the film of fuel also on the wall 15, a heating channel 26 having an engine cooling-water inlet 27 and an engine cooling-water outlet 28 passes through the corresponding structural part 17.

I claim:

1. A fuel-air mixture-forming device for internal combustion engine comprising a nozzle body of rotational symmetry;

a throttle member of rotational symmetry which is displaceable in the nozzle body, the nozzle body and the throttle body together forming a convergent-divergent nozzle and a radial diffusor; and wherein the nozzle body has a slot which extends around the nozzle in the vicinity of its narrowest cross section and discharges into the nozzle, the nozzle discharging into the diffusor, there being at least one fuel line which opens into the slot;

the radial diffusor is formed by a region of the nozzle body which is curbed outward in the direction of flow of the mixture and by a wall; and the mixture-forming device includes a structural member having said wall and forming a structural unit with an intake pipe of the internal combustion engine, said wall lying opposite the throttle member and downstream thereof and being of rotational symmetry with respect to a longitudinal axis of the throttle member; and said wall has a bulge facing the throttle member.

2. A mixture-forming device according to claim 1, wherein said nozzle body has an outwardly curved region and a heating device located in the outwardly curved region.

3. A fuel-air mixture-forming device for internal combustion engines comprising a nozzle body of rotational symmetry;

a throttle member of rotational symmetry which is displaceable in the nozzle body, the nozzle body and the throttle body together forming a convergent-divergent nozzle and a radial diffusor; and wherein the nozzle body has a slot which extends around the nozzle in the vicinity of its narrowest cross section and discharges into the nozzle, the nozzle discharging into the diffusor, there being at least one fuel line which opens into the slot;

the radial diffusor is formed by a region of the nozzle body which is curved outward in the direction of flow of the mixture and by a wall;

the mixture-forming device includes a structural member having said wall and forming a structural unit with an intake pipe of the internal combustion engine, said wall lying opposite the throttle member and being of rotational symmetry with respect to a longitudinal axis of the throttle member;

said wall has a bulge facing the throttle member;

said nozzle body has an outwardly curved region and a heating device located in the outwardly curved region; and said mixture-forming device includes a further heating device located in said structural member.

4. A mixture-forming device according to claim 3, wherein said first-mentioned heating device and said further heating device are operative with a fluid heated by the internal combustion engine, the fluid being cooling water, lubricating oil or exhaust gas.

5. A mixture-forming device according to claim 3, wherein said first-mentioned heating device and said further heating device are operative to be heated electrically.

6. A mixture-forming device according to claim 1, further comprising a heating device located in said structural member.

* * * * *